US006865749B2

(12) United States Patent
Mohney

(10) Patent No.: US 6,865,749 B2
(45) Date of Patent: Mar. 15, 2005

(54) HANG LINE TOWEL

(76) Inventor: Kenneth Robert Mohney, 9237 Sabal Palm Cir., Windermere, FL (US) 34786

( * ) Notice: Subject to any disclaimer, the term of this patent is extended or adjusted under 35 U.S.C. 154(b) by 58 days.

(21) Appl. No.: 10/085,459

(22) Filed: Feb. 27, 2002

(65) Prior Publication Data

US 2003/0014801 A1 Jan. 23, 2003

Related U.S. Application Data

(60) Provisional application No. 60/305,700, filed on Jul. 16, 2001.

(51) Int. Cl.[7] ..... A41D 13/04

(52) U.S. Cl. ..... 2/48; 2/49.1; 2/52

(58) Field of Search ..... 2/46–48, 49.1–49.5, 2/50–52, 104, 243.1, 88, 89, 92, 206, 207, 211, 219, 105, 74, 69, 69.5; 15/208, 209.1; 24/7, 8, 9, 3.4, 3.13, 3.9, 591.1, 572.1, 595.1, 604; D2/861

(56) References Cited

U.S. PATENT DOCUMENTS

| | | | | | |
|---|---|---|---|---|---|
| 2,420,344 | A | * | 5/1947 | Cook | 2/69 |
| 2,612,139 | A | * | 9/1952 | Joseph | 119/865 |
| 2,706,817 | A | * | 4/1955 | Schneider | 2/48 |
| 2,820,269 | A | * | 1/1958 | Wolff | 2/52 |
| 3,530,547 | A | * | 9/1970 | Robinson | 403/182 |
| 3,619,816 | A | * | 11/1971 | Cowen | 2/48 |
| 4,014,045 | A | * | 3/1977 | Moyer | 2/51 |
| 4,246,679 | A | * | 1/1981 | Monett | 24/587.11 |
| 4,669,128 | A | | 6/1987 | Furgang | |
| 4,685,154 | A | * | 8/1987 | Smith | 2/48 |
| 4,698,854 | A | * | 10/1987 | Slimmon | 2/48 |
| 4,794,029 | A | | 12/1988 | Tennant et al. | |
| 4,993,611 | A | * | 2/1991 | Longo | 224/148.4 |
| 5,027,477 | A | * | 7/1991 | Seron | 24/3.4 |
| D336,199 | S | | 6/1993 | Bazata, Jr. | |
| 5,322,918 | A | * | 6/1994 | Kirby | 2/48 |
| 5,467,487 | A | | 11/1995 | Sicard | |
| 5,617,584 | A | | 4/1997 | Brennan | |
| 5,629,071 | A | | 5/1997 | Feldman | |
| 5,756,177 | A | * | 5/1998 | Cheong | 2/69 |
| 5,829,056 | A | * | 11/1998 | Hubert | 2/48 |
| 5,843,556 | A | | 12/1998 | Levas | |
| 5,852,849 | A | * | 12/1998 | Lansing et al. | 24/3.4 |
| 5,893,171 | A | * | 4/1999 | Ries | 2/48 |
| 5,956,762 | A | * | 9/1999 | Adams | 2/48 |
| 5,960,471 | A | * | 10/1999 | Burton | 2/48 |
| 6,058,530 | A | | 5/2000 | Wheeler | |
| 6,129,452 | A | | 10/2000 | Hakulin | |
| 6,334,220 | B1 | * | 1/2002 | Frye | 2/49.2 |
| 6,505,367 | B2 | * | 1/2003 | Griffin et al. | 2/48 |
| 6,562,437 | B2 | * | 5/2003 | Bunkley | 428/126 |
| 6,718,554 | B1 | * | 4/2004 | Langston | 2/49.1 |

* cited by examiner

*Primary Examiner*—A. Vanatta
(74) *Attorney, Agent, or Firm*—Edward M. Livingston

(57) ABSTRACT

A towel (1) has a hang line (2) attached predeterminedly to a top edge of a towel that is articulated to hang from an individual's neck (7) or waist (8) with the towel extending predeterminedly down and around the individual. Advertisement material (15) can be placed on the towel and/or the hang line as a potentially attractive and prestigious advertising means. The towel can be used as a container, optionally like a furoshiki, with containment fasteners (16).

18 Claims, 7 Drawing Sheets

HANG LINE TOWEL

CROSS-REFERENCE TO RELATED APPLICATION

This is application claims the benefit of U.S. Provisional Application No. 60/305,700, filed Jul. 16, 2001.

BACKGROUND OF THE INVENTION

This invention relates to towels for body wiping, protection and privacy while attached to a human body during uses that can include physical workout, shaving, applying makeup, being in the presence of other people between personal care activities, being unclothed in variously inclement surroundings, and/or other activities before being clothed.

Robes, tote towels and other modifications of towels are well known. In a manner taught by this invention, however, none are known to provide body wiping, protection and privacy while attached to a human body during uses that can include physical workout, shaving, applying makeup, hair dressing, doing common chores, being in the presence of other people, being between personal care activities, and/or being unclothed in variously inclement surroundings, and/or other activities before being clothed.

Examples of most closely related known but different devices are described in the following patent documents:

| U.S. Pat. No. | Inventor | Issue Date |
|---|---|---|
| Des 336,199 | Bazata, Jr. | Jun. 08, 1993 |
| 4,669,128 | Furgang | Jun. 02, 1987 |
| 5,617,584 | Brennan | Apr. 08, 1997 |
| 5,629,071 | Feldman | May 13, 1997 |
| 5,467,487 | Sicard | Nov. 21, 1995 |
| 6,129,452 | Hakulin | Oct. 10, 2000 |
| 5,843,556 | Levas | Dec. 01, 1998 |
| 6,058,530 | Wheeler | May 09, 2000 |
| 4,794,029 | Tennant, et al. | Dec. 27, 1988 |

SUMMARY OF THE INVENTION

Objects of patentable novelty and utility taught by this invention are to provide a hang-line towel which:

- can be suspended from a neck, from a back or from hips of an individual and hung down over a chest, breasts and/or genitals of an individual while being used to wipe, protect and cover the individual selectively during activities that can include exercising, shaving, applying makeup, going from-place-to-place unclothed, and/or other activities before getting clothed;
- can be articulated to wrap the individual selectively;
- can include pockets and/or attachment loops for containing valuables, keys and necessities during such activities;
- can be articulated to be hung from rods or lines for drying and aerating between uses;
- can be articulated to be hung from a shoulder for ease in carrying for going to the beach, pool and other uses versus stuffing into a bag;
- can be hung on a rod to dry where easily accessible instead of folded or laid down when not in use; and
- can include four corner hooks for use as a furoshiki to carry desired items.

This invention accomplishes these and other objectives with a towel having a hang line attached predeterminedly to an edge of the towel and articulated to hang the towel from an individual's neck, back or hips with the towel extending predeterminedly down and around the individual. Advertisement can be added to the towel and to the hang line for use by institutions as a unique and potentially attractive instrument for a medium of advertising.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

Figure 1:
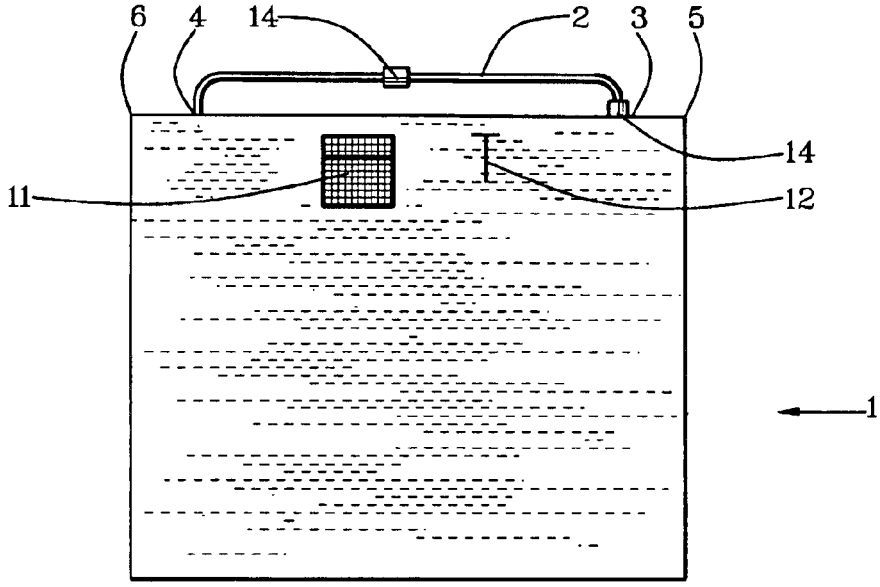
FIG. 1 is a front elevation view of a hang-line towel that is articulated to extend over an individual's neck to proximate an individual's mid section.
Figure 2:
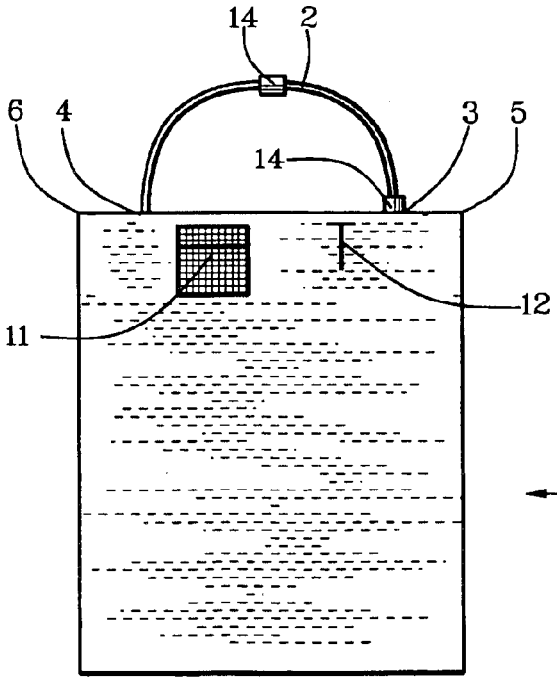
FIG. 2 is the FIG. 1 illustration with ends slightly looped to partially encircle the individual's torso and a hang line looped to be put around the individual's neck.

1. Towel
2. Hang line
3. First attachment portion
4. Second attachment portion
5. First top corner
6. Second top corner
7. Neck
8. Waist
9. Arm
10. Top-corner fastener
11. Valuables container
12. Hook fastener
13. Pocket
14. Pressure-release fastener
15. Advertisement material
16. Containment fastener Referring to FIGS. 1–3, a hang-line towel has a towel 1 that is made preferably of terry cloth that is predeterminedly rectangular. A hang line 2 is shown as being attached to a top edge of the towel 1. The hang line 2 could be attached to various places on any edge of the towel 1, so long as it forms a loop for hanging the towel 1 around an individual's neck. The hang line 2 has a hang loop intermediate a first attachment portion 3 of the towel 1 and a second attachment portion 4 of the towel 1. The first attachment portion 3 is predeterminedly proximate a first top corner 5 and the second attachment portion 4 is a predetermined distance from the first top corner 5 towards a second top corner 6.

Figure 12:
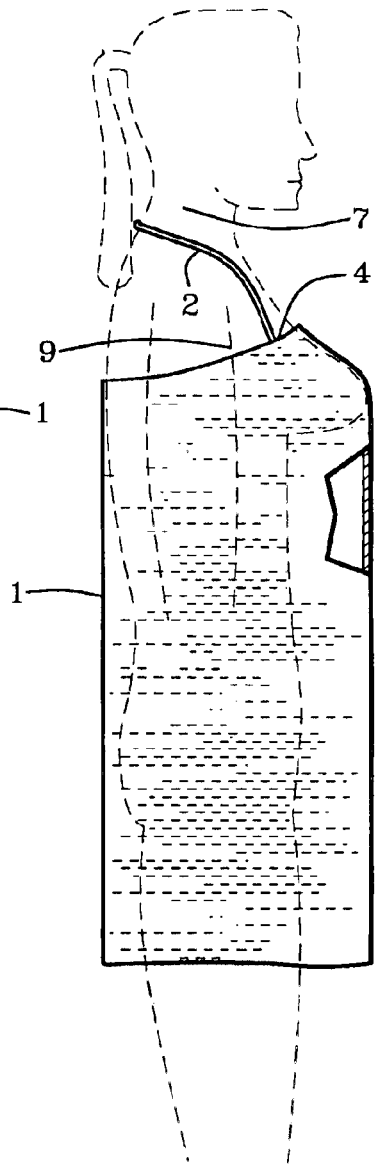
FIG. 12 is a partially cutaway side elevation view of the hang-line towel that is articulated to hang below the genital area and to wrap around the individual who is an adult female.
Figure 13:
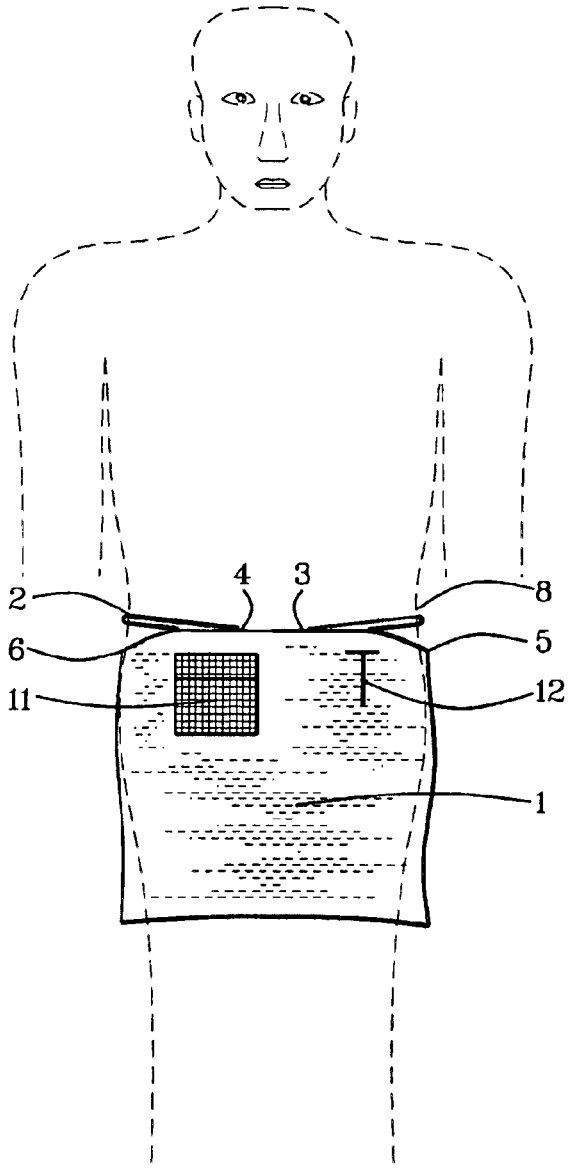
FIG. 13 is a partially cutaway front elevation view of the hang-line towel that is articulated to hang from a mid section to below the genital area of the individual.
Figure 14:
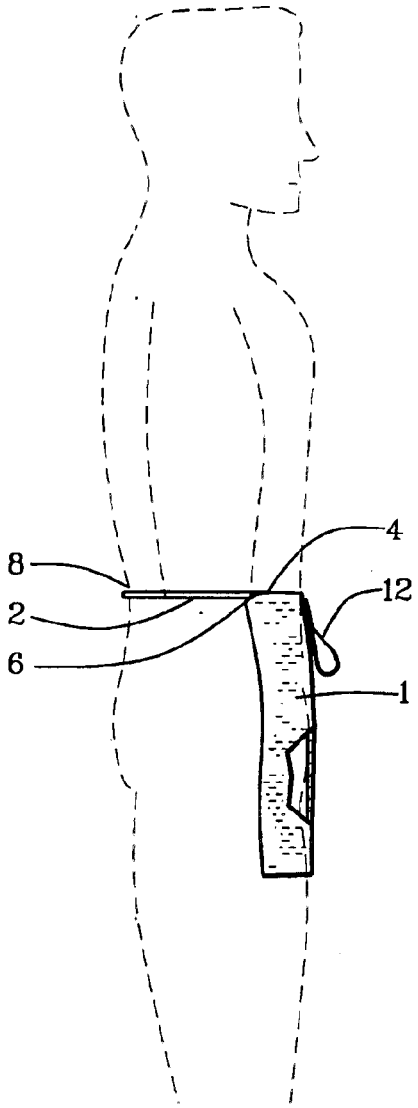
FIG. 14 is a partially cutaway side view of the FIG. 13 illustration.

The hang line 2 is articulated to encircle predeterminedly a predetermined towel-hang portion of an individual's torso for hanging the towel 1 from the individual. The hang line 2 may be made of non-stretchable cloth or stretchable elastomeric material, such as rubber enclosed in cloth, depending on the application and desires of the user. The towel-hang portion of the individual's torso can include the individual's neck 7 as depicted in FIGS. 3–12 or the individual's waist 8 as depicted in FIGS. 13–14.

The towel 1 can be articulated to extend predeterminedly down from the towel-hang portion of the individual and to extend from a first side of the individual that is vertically below the first top corner 5 of the towel 1 to a second side of the individual and to extend about the individual predeterminedly. There need be no distinction between left and right sides of the individual.

Figure 3:
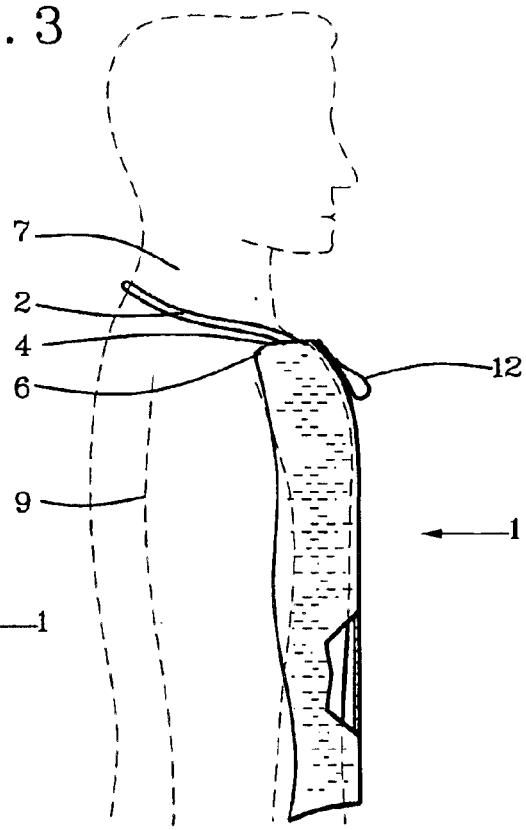
FIG. 3 is a partially cutaway side elevation view of the FIG. 1 hang-line towel on a top portion of the individual.
Figure 4:
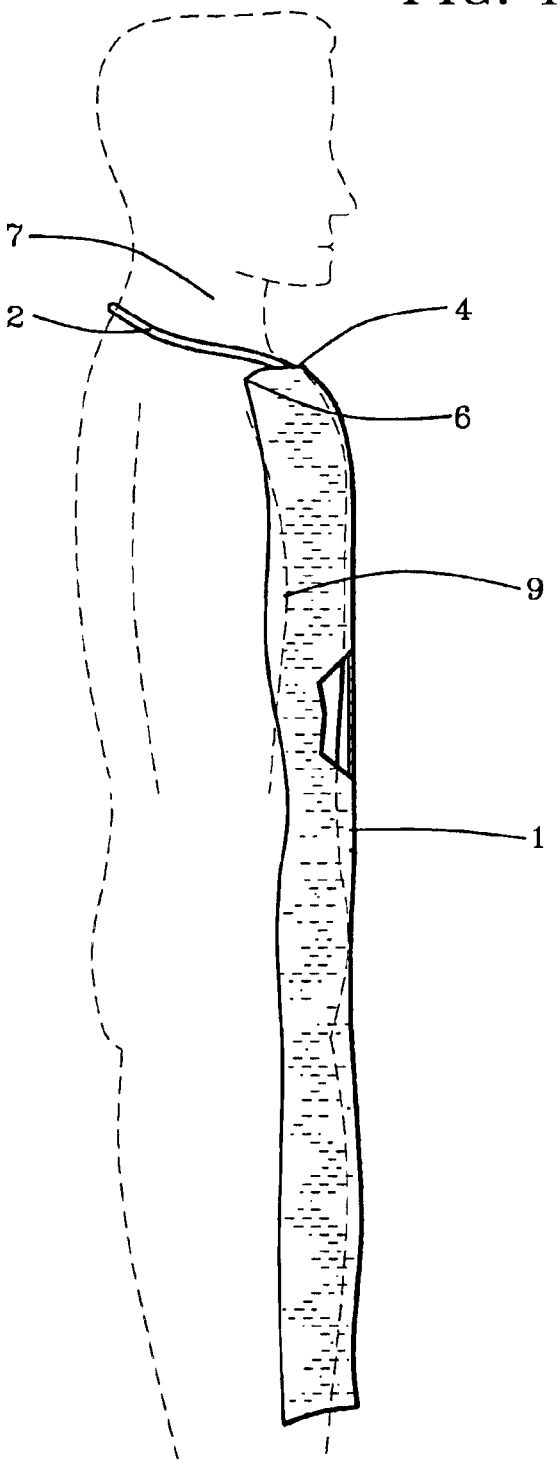
FIG. 4 is a partially cutaway side elevation view of the hang-line towel that is articulated to extend to predeterminedly below the genital portion of the individual on which it is positioned.
Figure 5:
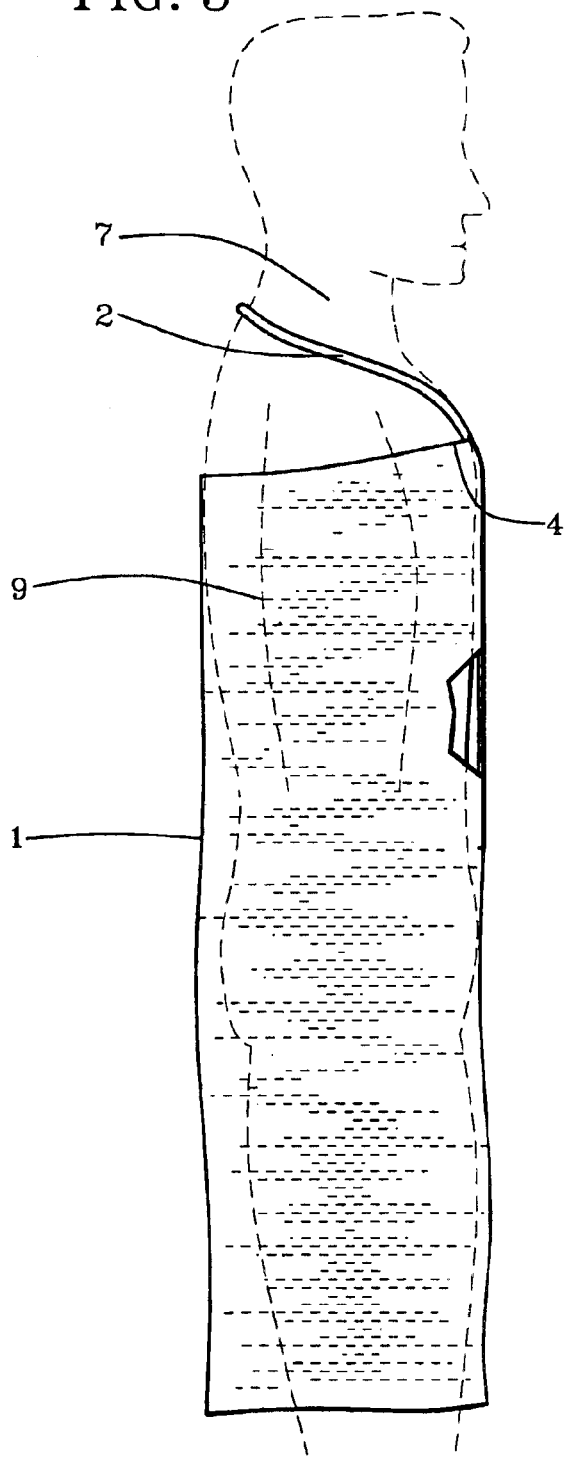
FIG. 5 is a partially cutaway side elevation view of the hang-line towel that is articulated to wrap around and to extend to predeterminedly below the genital portion of the individual on which it is positioned.

FIG. 3 shows the towel 1 having been articulated to hang from the individual's neck to mid section. FIGS. 4, 7, 9 and 11 show the towel 1 having been articulated to hang from the individual's neck 7 to below the individual's genital area. FIGS. 5, 8 and 12 show the towel 1 having been articulated to hang from lower down from the individual's neck 7 in order to pass under the individuals arm 9 for being wrapped around the individual with the second top corner 6 meeting the first top corner 5 for attachment with a top-corner fastener 10 that is shown in FIG. 8.

Referring to FIGS. 1–2, 9, 13 and 15–16, the towel 1 can include a valuables container 11 that is articulated to receive and to retain at least one valuable item predeterminedly.

Referring further to FIGS. 1–2, 9, 13–14 and 15–16, the towel 1 can include a hook fastener 12 that is articulated to fasten items that include keys and a finger ring to the towel 1.

Figure 9:
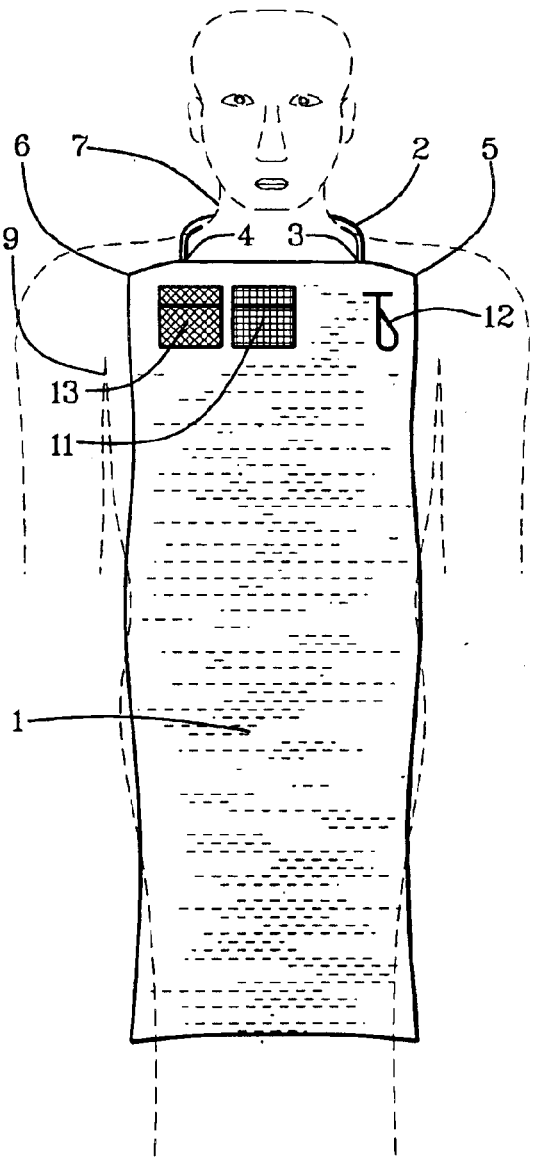
FIG. 9 is a front elevation view of the hang-line towel that hangs below the individual's genital area and includes containers and a hook fastener.
Figure 10:
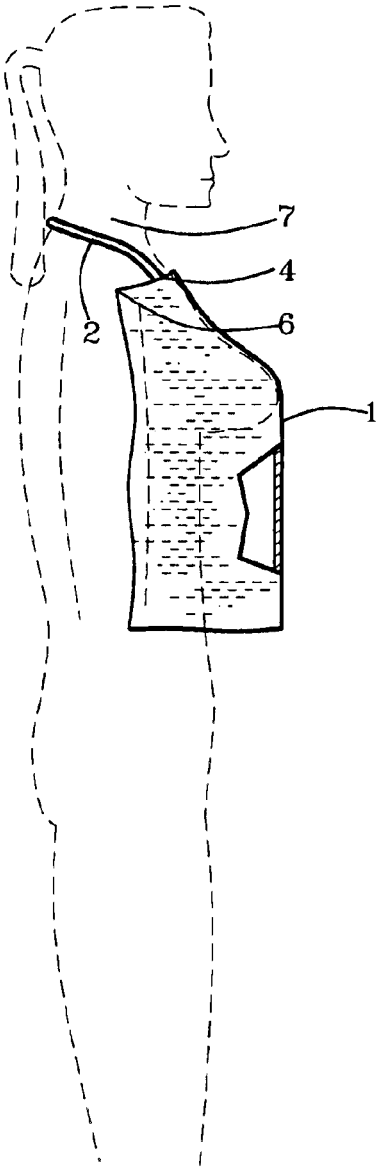
FIG. 10 is a partially cutaway side elevation view of the hang-line towel that is articulated to hang to a mid section of the individual who is an adult female.
Figure 11:
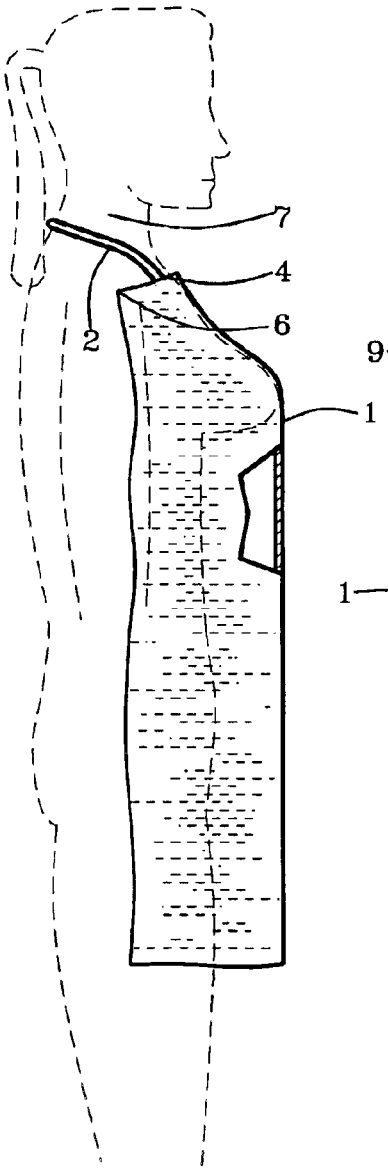
FIG. 11 is a partially cutaway side elevation view of the hang-line towel that is articulated to hang below the genital area of the individual who is an adult female.
Figure 16:
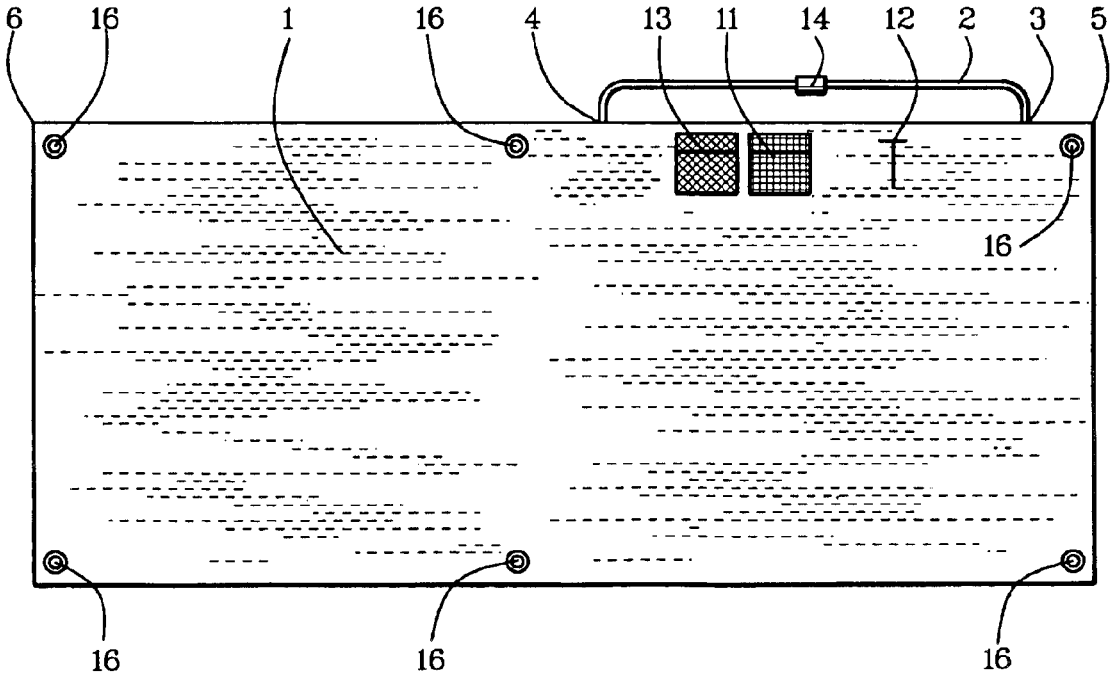
FIG. 16 is a front elevation view of fasteners for furoshiki use on the hang-line towel that is articulated to hang below the individual's genital area and to wrap around the individual.

Referring to FIGS. 9, 13 and 16, the towel 1 can include at least one pocket 13 that is articulated to contain and to prevent unintended removal of a wallet predeterminedly.

Referring to FIGS. 1–2 and 15–16, attachment of the hang line 2 to the towel 1 is preferably tension releasable with at least one pressure-release fastener 14 for allowing release of attachment predeterminedly for protection against the individual's being drawn into harm's way with an exercise machine or other object to which the towel 1 may become caught. The pressure-release fastener 14 also can be made lockable not to release with pressure in order to protect against the towel 1 being pulled off.

The hang line 2 can be selected from a class of lines that includes rope, string, chain, and cloth fabric. Terry-cloth rope may be preferred for some exercise criteria. The hang line 2 may be made stretchable by use of elastomeric material covered with cloth. Cloth fabric may be preferred for inclusion of attractive advertising and aesthetic objectives.

Figure 6:
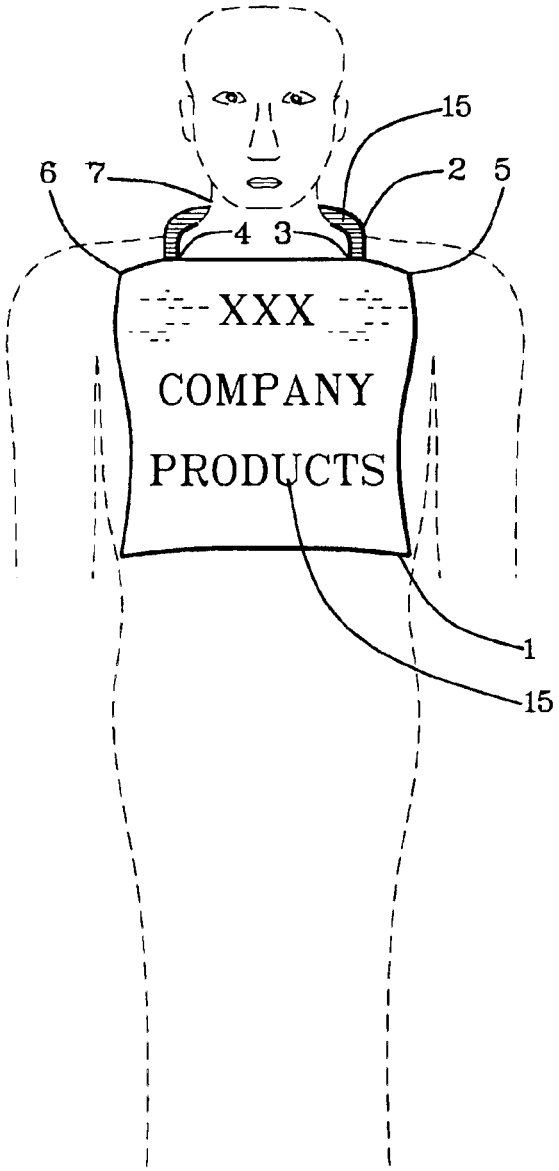
FIG. 6 is a front elevation view of the hang-line towel that is mid length on the individual and includes advertisement.
Figure 7:
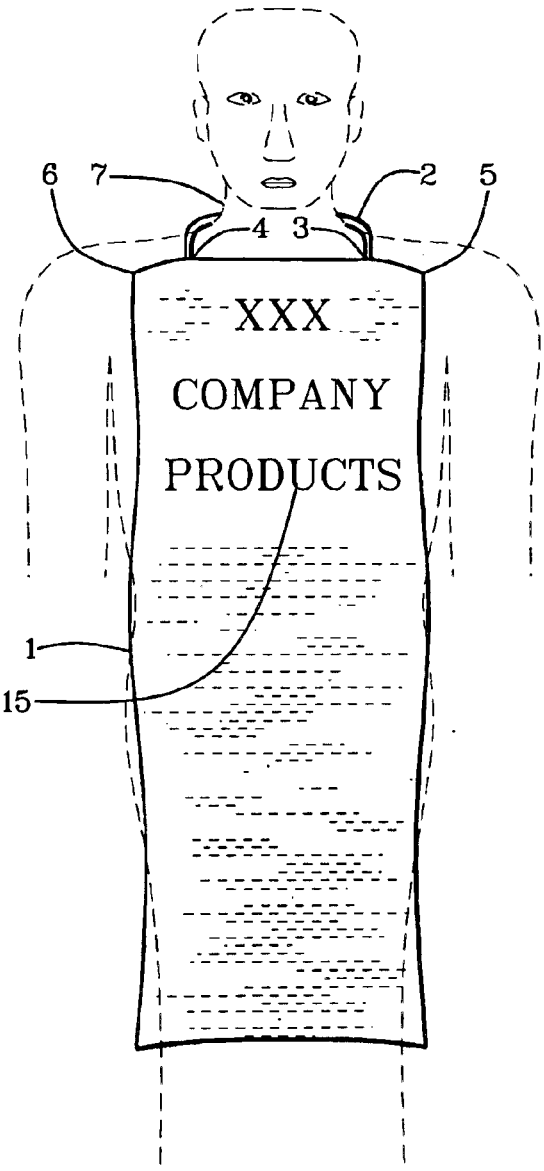
FIG. 7 is a front elevation view of the hang-line towel that hangs below the individual's genital area and includes advertisement.
Figure 8:
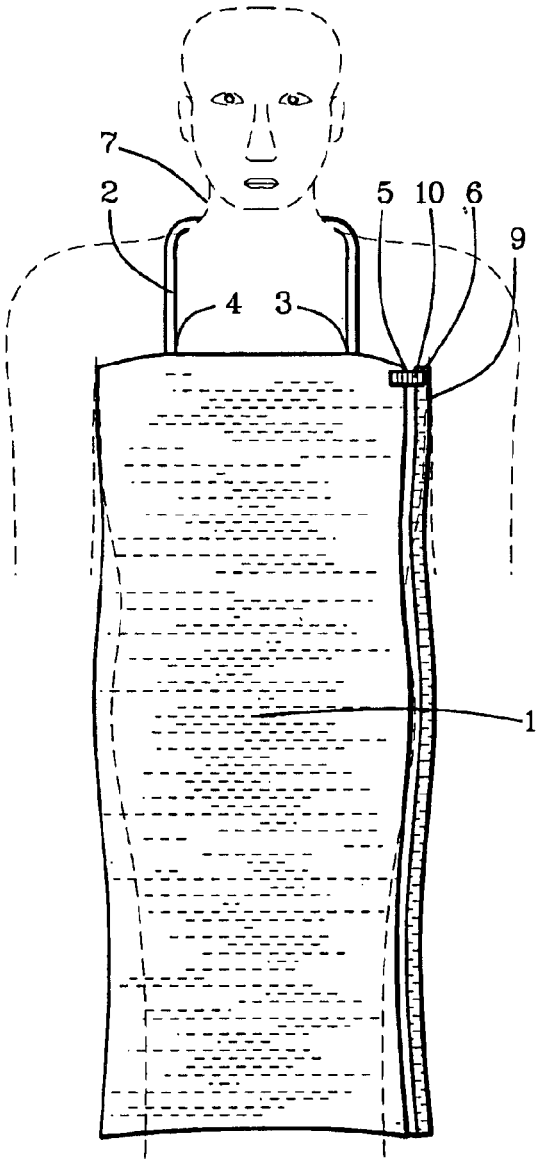
FIG. 8 is a front view of the hang-line towel that is articulated to wrap around and to extend to predeterminedly below the genital portion of the individual on which it is positioned.

Referring to FIGS. 6–7, the towel 1 and the hang line 2 can include advertisement material 15 and aesthetics as desired.

Figure 15:
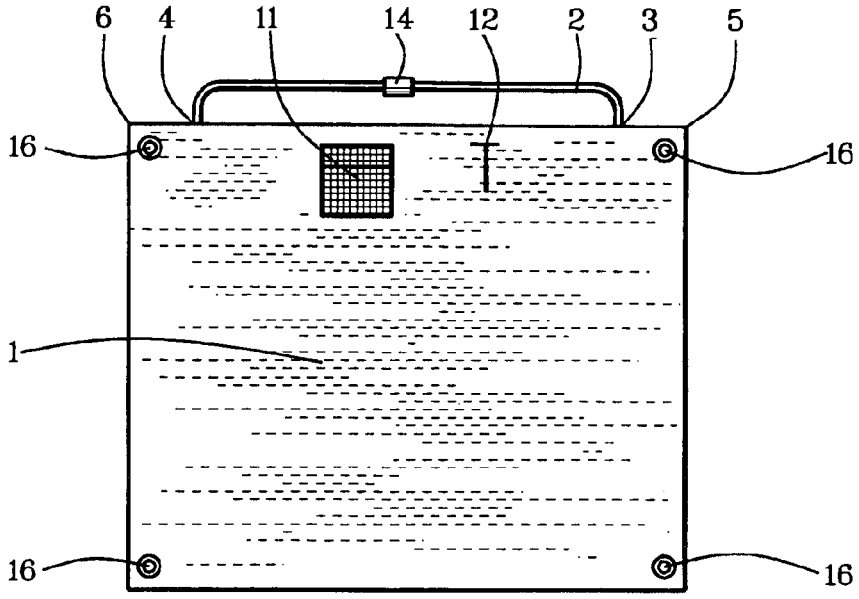
FIG. 15 is a front elevation view of the hang-line towel that is articulated to hang to a mid section of the individual and has fasteners at four corners for furoshiki use.

Referring to FIGS. 15–16, a containment fastener 16 can be provided on each of four corners of the towel 1 for fastening the four corners of the towel 1 together for furoshiki use. Different from a furoshiki, the towel 1 is not made of thin material that allows the four corners to be tied together easily. Instead, being made of a towel material like terry cloth, either of a wide variety of fabric fasteners, represented by a ring, can be used as the containment fastener 16 for fastening the four corners together. For relatively long rectangularity as for the towel 1 with a wraparound length as depicted in FIG. 16, containment fasteners 16 can be positioned proximate squareness positions and at ends as shown. The containment fasteners 16 can be used as either corner-tie furoshiki fasteners or as roll-up fasteners.

Between uses by individuals the hang-ling towel can be hung on a pole, a clothes hanger or other member to be dried and accessed easily for use.

A method for using this hang-line towel includes providing a suitably attractive design on a suitably high-quality hang-line towel and including therewith an addressed identification of an advertiser. Then it can be distributed commercially to users for use at body-builder and sports facilities. Different from T-shirts and exercise clothes with advertisement, the hang towel can be more prestigious and adaptable to a wide variety of more precisely directed advertising. It can provide a major new form of advertising.

A new and useful hang-line towel having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A hang-line towel comprising:

a uniformly planar towel having a hang line attached predeterminedly to a top edge of the towel;

the hang line having two ends, a first end connected to the towel at a first attachment portion of the towel and a second end connected to the towel at a second attachment portion of the towel;

the first attachment portion of the towel being predeterminedly proximate a first top corner of the towel;

the second attachment portion of the towel being a predetermined distance from the first top corner towards a second top corner of the towel;

the hang loop being articulated to encircle predeterminedly a predetermined towel-hang portion of an individual's torso for hanging the towel from the individual;

a tension-release fastener positioned on the hang line intermediate the first attachment portion and the second attachment portion of the towel to allow tension release of attachment, wherein the tension-release fastener includes two elongated components, one component attached to one attachment portion of the hang line having a male extension at an outer end and the other component attached to the other attachment portion of the hang line having a female recess at an outer end for interlocking said components so as to connect the two attachment portions of the hang line to one another;

the towel being articulated to extend predeterminedly down from the towel-hang portion of the individual's torso and having an unattached bottom edge to allow the towel to hang freely so it can be moved to wipe the individual's torso; and the towel being articulated to extend from a first side of the individual that is vertically below the first top corner of the towel to a second side of the individual and to extend about the individual predeterminedly.

2. The hang-line towel of claim 1 wherein:

the towel-hang portion of the individual's torso for which the hang loop is articulated to encircle is the individual's neck.

3. The hang-line towel of claim 2 wherein:

the towel is articulated to extend to proximate a mid section of the individual's torso.

4. The hang-line towel of claim 2 wherein:

the towel is articulated to extend to predeterminedly below a genital portion of the individual's torso.

5. The hang-line towel of claim 4 wherein:

the towel is articulated to extend completely about the individual's torso; and the second top corner and the first top corner of the towel include a top-corner fastener with which the first top corner and the second top corner can be fastened together.

6. The hang-line towel of claim 1 wherein:

the towel-hang portion of the individual's torso for which the hang loop is articulated to encircle is the individual's waist.

7. The hang-line towel of claim 6 wherein:

the towel is articulated to extend to predeterminedly below a genital portion of the individual's torso.

8. The hang-line towel of claim 7 wherein:

the towel is articulated to extend completely about the individual's torso; and the second top corner and the first top corner of the towel include a top-corner fastener with which the first top corner and the second top corner can be fastened together.

9. The hang-line towel of claim 1 wherein:

the towel includes a valuables container that is articulated to receive and to retain at least one valuable item predeterminedly.

10. The hang-line towel of claim 1 wherein:

the towel includes at least one pocket.

11. The hang-line towel of claim 10 wherein:

the pocket is articulated to contain and to prevent unintended removal of a wallet predeterminedly.

12. The hang-line towel of claim 1 wherein:

the towel includes a hook fastener that is articulated to fasten items that include at least a key and a finger ring to the towel.

13. The hang-line towel of claim 1 wherein:

the hang line is selected from a class of lines that includes rope, string, belting, chain, and cloth fabric.

14. The hang-line towel of claim 1 wherein:

the bang line includes advertisement material.

15. The hang-line towel of claim 1 wherein:

the towel includes advertisement material.

16. The hang-line towel of claim 15 wherein:

the hang line includes advertisement material.

17. The hang-line towel of claim 1 and further comprising:

a containment fastener on each of four corners of the towel being four fasteners for fastening the four corners together for furoshiki use.

18. The hang-line towel of claim 17 wherein:

the towel includes substantial rectangularity and two of the containment fasteners are positioned as square-distance fasteners at proximate a towel-width distance from a first end of the towel.

* * * * *